US011798729B2

(12) United States Patent
Igarashi

(10) Patent No.: US 11,798,729 B2
(45) Date of Patent: Oct. 24, 2023

(54) COIL COMPONENT

(71) Applicant: Murata Manufacturing Co., Ltd., Kyoto-fu (JP)

(72) Inventor: Akio Igarashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 693 days.

(21) Appl. No.: 16/721,616

(22) Filed: Dec. 19, 2019

(65) Prior Publication Data

US 2020/0243249 A1 Jul. 30, 2020

(30) Foreign Application Priority Data

Jan. 28, 2019 (JP) ..... 2019-012036

(51) Int. Cl.

| | |
|---|---|
| ***H01F 27/28*** | (2006.01) |
| ***H01F 27/24*** | (2006.01) |
| ***H01F 17/04*** | (2006.01) |
| ***H01F 41/07*** | (2016.01) |

(52) U.S. Cl.

CPC ..... *H01F 27/2823* (2013.01); *H01F 17/045* (2013.01); *H01F 27/24* (2013.01); *H01F 41/07* (2016.01); *H01F 2027/2838* (2013.01)

(58) Field of Classification Search

CPC .... H01F 27/2823; H01F 17/045; H01F 27/24; H01F 41/07; H01F 2027/2838

See application file for complete search history.

(56) References Cited

U.S. PATENT DOCUMENTS

| | | | | |
|---|---|---|---|---|
| 1,781,308 | A * | 11/1930 | Vos | H01F 27/2823 336/185 |
| 8,686,822 | B2 * | 4/2014 | Huang | H01F 27/292 336/170 |
| 8,937,522 | B2 * | 1/2015 | Lai | H01F 27/29 336/212 |
| 9,852,839 | B2 * | 12/2017 | Takagi | H01F 27/327 |
| 10,504,647 | B2 * | 12/2019 | Renteria | H01F 27/24 |
| 2008/0309445 | A1 * | 12/2008 | Suzuki | H01F 41/069 336/183 |
| 2009/0219127 | A1 * | 9/2009 | Tomonari | H01F 27/29 336/192 |

(Continued)

FOREIGN PATENT DOCUMENTS

| | | | |
|---|---|---|---|
| JP | 2008-186996 | A | 8/2008 |
| JP | 2008186996 | A * | 8/2008 |

(Continued)

OTHER PUBLICATIONS

An Office Action; "Notice of Reasons for Refusal," mailed by the Japanese Patent Office dated Sep. 21, 2021, which corresponds to Japanese Patent Application No. 2019-012036 and is related to U.S. Appl. No. 16/721,616 with English translation.

*Primary Examiner* — Mang Tin Bik Lian

(74) *Attorney, Agent, or Firm* — Studebaker & Brackett PC

(57) ABSTRACT

A coil component includes a core including a winding core portion, a first wire, a second wire, a third wire, and a fourth wire that are wound around the winding core portion. A winding portion is formed by winding the respective first to fourth wires around the winding core portion. The winding portion includes a twisted wire portion in which the first wire, the second wire, the third wire, and the fourth wire are collectively twisted.

21 Claims, 9 Drawing Sheets

(56) References Cited

U.S. PATENT DOCUMENTS

| | | | | |
|---|---|---|---|---|
| 2014/0070914 | A1* | 3/2014 | Oki | H01F 41/0206 336/233 |
| 2014/0292465 | A1* | 10/2014 | Takagi | H01F 27/292 336/192 |
| 2015/0061811 | A1* | 3/2015 | Takagi | H01F 27/292 336/192 |
| 2016/0379756 | A1* | 12/2016 | Yamakita | H01F 41/069 242/439.1 |
| 2017/0025212 | A1* | 1/2017 | Jerez | H01F 27/29 |
| 2017/0069425 | A1* | 3/2017 | Yamakita | H01F 41/076 |
| 2018/0330882 | A1 | 11/2018 | Yamaguchi | |

FOREIGN PATENT DOCUMENTS

| | | | |
|---|---|---|---|
| JP | 2012-248610 | A | 12/2012 |
| JP | 2018-195605 | A | 12/2018 |

* cited by examiner

COIL COMPONENT

CROSS-REFERENCE TO RELATED APPLICATIONS

This application claims benefit of priority to Japanese Patent Application No. 2019-012036, filed Jan. 28, 2019, the entire content of which is incorporated herein by reference.

BACKGROUND

Technical Field

The present disclosure relates to a coil component.

Background Art

As a coil component, a surface-mount type pulse transformer has been known in which a first wire and a second wire are bifilar-wound on a winding core portion of a core, and a third wire and a fourth wire are bifilar-wound on the first wire and the second wire, as described, for example, Japanese Unexamined Patent Application Publication No. 2012-248610. In a pulse transformer disclosed in Japanese Unexamined Patent Application Publication No. 2012-248610, since positions of a first wire and a second wire in one turn closest to one end or the other end of a winding core portion are reversed relative to positions of other turns, insertion loss of the pulse transformer in a frequency band for use is increased, thereby making it possible to substitute for a notch filter.

Incidentally, in Japanese Unexamined Patent Application Publication No. 2012-248610, since a notch filter is substituted in a specific frequency band for use (62.5 MHz), for example, a signal waveform in a system using a plurality of frequencies may attenuate and communication quality may deteriorate.

SUMMARY

Accordingly, the present disclosure provides a coil component capable of improving versatility for a communication band.

A coil component according to an embodiment of the present disclosure includes a core having a winding core portion, and a first wire, a second wire, a third wire, and a fourth wire wound around the winding core portion, in which a winding portion is formed by winding the first wire, the second wire, the third wire, and the fourth wire around the winding core portion. The winding portion includes a twisted wire portion in which the first wire, the second wire, the third wire, and the fourth wire are collectively twisted.

According to this configuration, the twisted wire portion is formed with the first wire, the second wire, the third wire, and the fourth wire in the winding portion, so that leakage inductance between wires is reduced. Also, for example, variation among a length of the first wire, a length of the second wire, a length of the third wire, and a length of the fourth wire is reduced compared to a configuration of the winding portion where the first wire and the second wire are wound around the core portion, the third wire and the fourth wire are wound on the first wire and the second wire. As a result, stray capacitance between the wires is reduced. As described above, the stray capacitance and leakage inductance are reduced, thereby reducing insertion loss in an entire frequency band. Therefore, it is possible to improve versatility of the coil component for the communication band.

Other features, elements, characteristics and advantages of the present disclosure will become more apparent from the following detailed description of preferred embodiments of the present disclosure with reference to the attached drawings.

BRIEF DESCRIPTION OF THE DRAWINGS

Each of FIG. 9A to FIG. 9C is a schematic cross-sectional view showing a winding core portion and one turn of a coil according to a modification.

DETAILED DESCRIPTION

Hereinafter, an embodiment will be described.

It should be noted that constituent elements in the accompanying drawings may be enlarged in order to facilitate understanding. A dimensional ratio of the constituent elements may be different from an actual ratio or may be different from that in the other figures. In addition, in the cross-sectional views, hatching of some constituent elements may be omitted to facilitate understanding.

Figure 1:
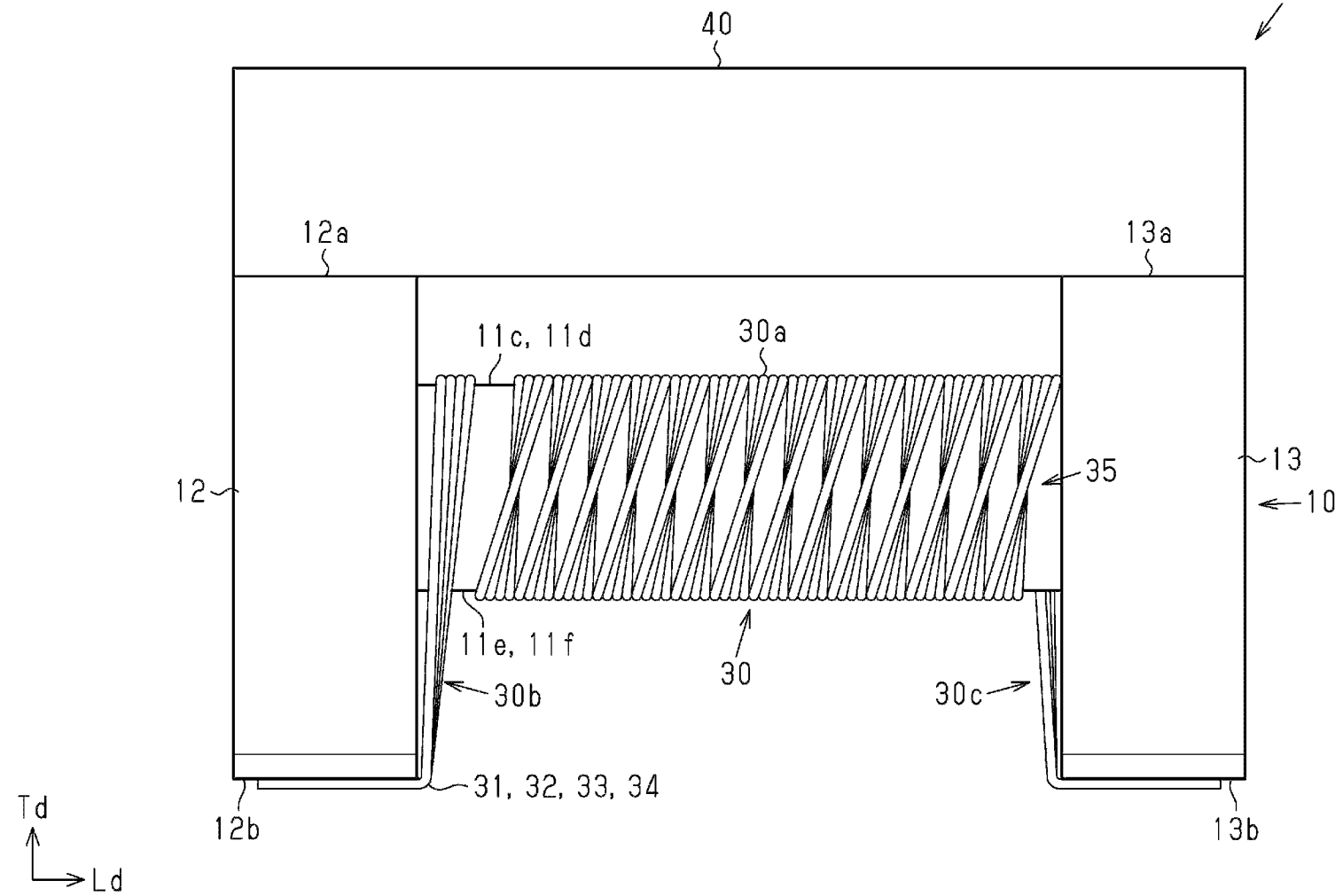
FIG. 1 is a schematic side view showing a coil component according to one embodiment.
Figure 2:
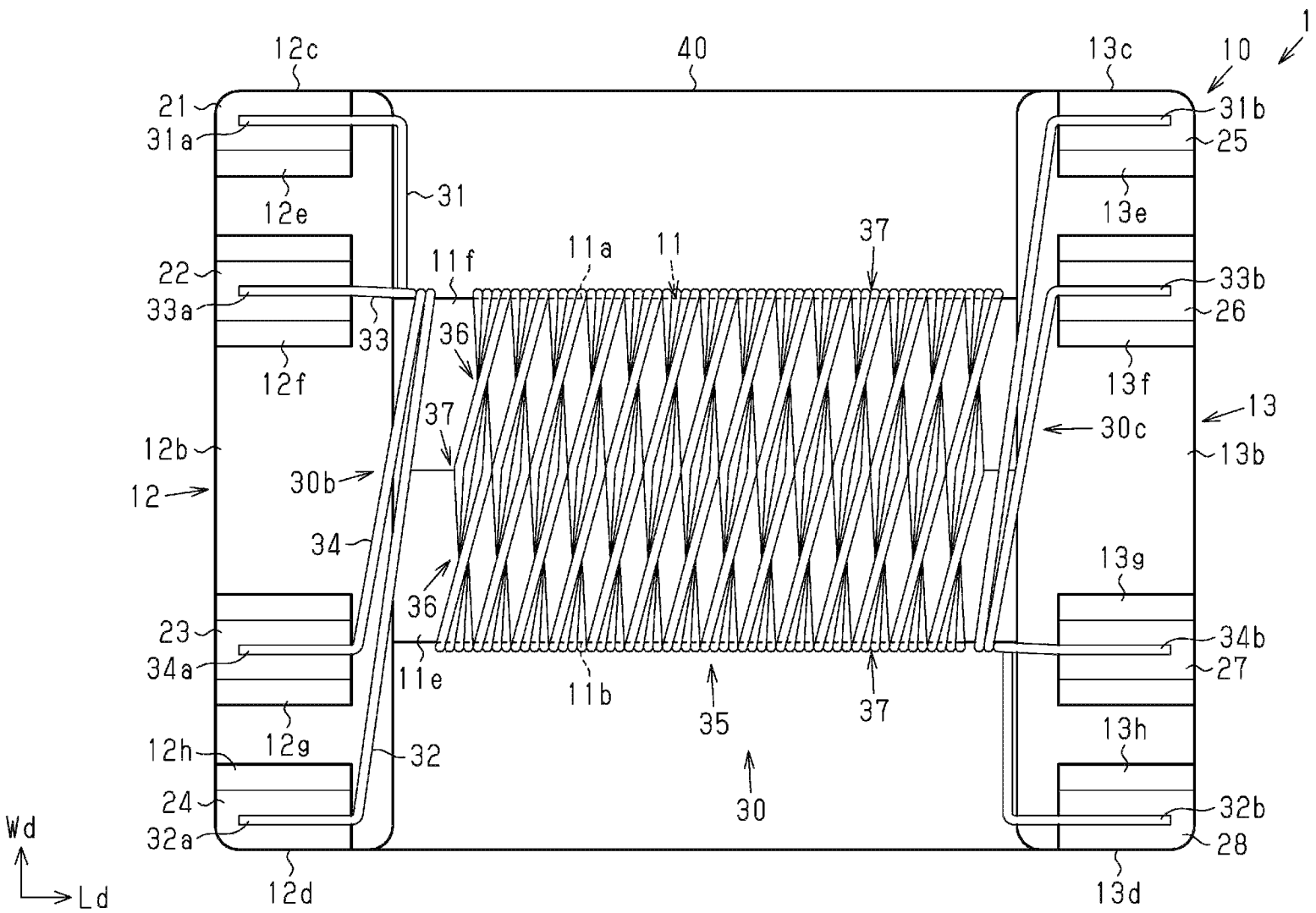
FIG. 2 is a schematic bottom view showing the coil component according to the one embodiment.

As shown in FIG. 1 and FIG. 2, a coil component 1 includes a core 10 and a coil 30 wound around the core 10. The coil component 1 is, for example, a surface-mount type coil component. The coil component 1 is used, for example, as a signal transformer. The coil component 1 is not limited to the signal transformer, and may be a common mode choke coil, a balun (balanced-to-unbalanced converter), or an inductor array.

The core 10 is made of a non-conductive material, and in particular, a non-magnetic material such as alumina, a magnetic material such as nickel (Ni)-zinc (Zn) ferrite, or the like. The core 10 is formed, for example, by firing a molded body obtained by compressing a non-conductive material. Note that the core 10 is not limited to that formed by firing the molded body obtained by compressing the non-conductive material, and may be formed, for example, by thermally curing resin containing magnetic powder such as metal powder, ferrite powder, or the like, resin containing non-magnetic powder such as silica powder, or resin containing no filler.

Figure 3:
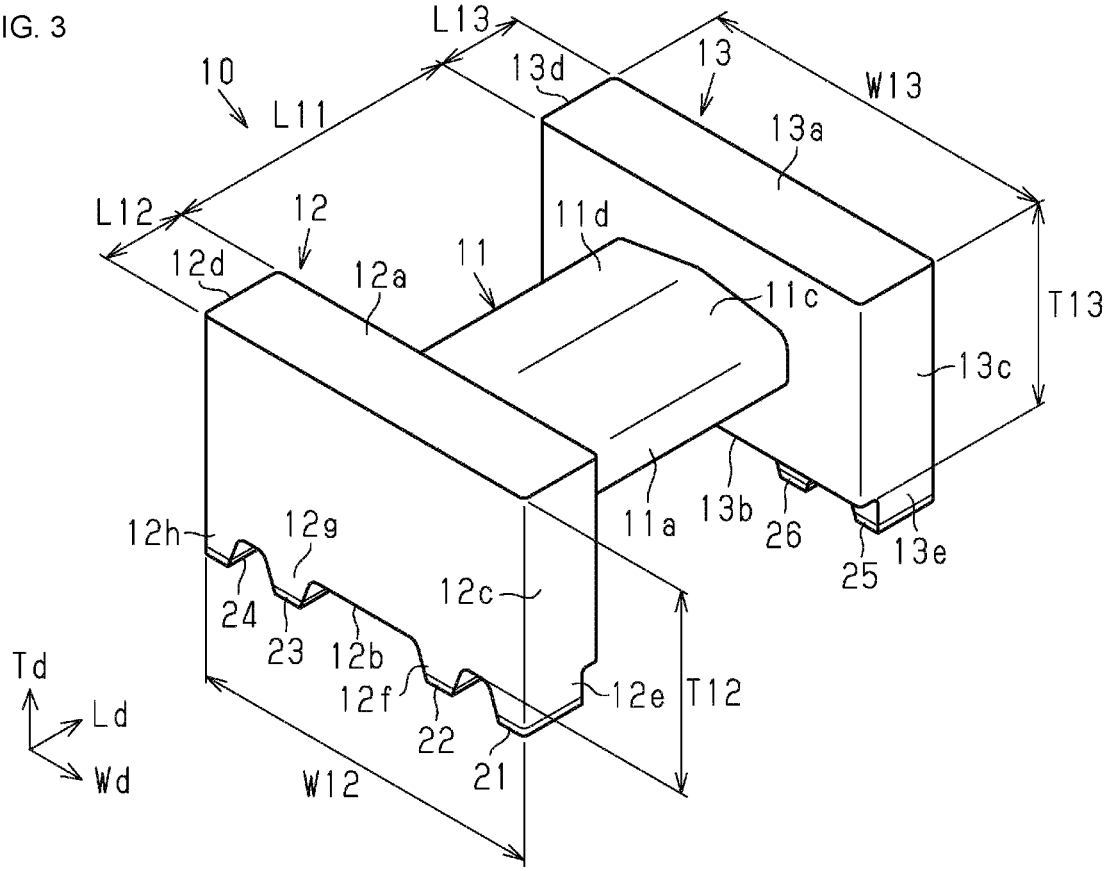
FIG. 3 is a perspective view showing a core.

As shown in FIG. 3, the core 10 includes a winding core portion 11 extending in a predetermined direction, a first flange portion 12 provided at a first end portion of the winding core portion 11 in the predetermined direction, and a second flange portion 13 provided at a second end portion which is an end portion opposite to the first end portion of the winding core portion 11 in the predetermined direction. In the present embodiment, the winding core portion 11, the first flange portion 12, and the second flange portion 13 are integrally formed. In the following description, the predetermined direction in which the winding core portion 11 extends is referred to as a "length direction Ld", a direction orthogonal to the length direction Ld in a plan view of the core 10 is referred to as a "width direction Wd", and a direction orthogonal to the length direction Ld and the width direction Wd is referred to as a "height direction Td". The length direction Ld can also be referred to as an arrangement direction of the first flange portion 12 and the second flange portion 13. In addition, the width direction Wd can be rephrased as a direction parallel to a main surface of a circuit board, in a state in which the coil component 1 is mounted on the circuit board, among directions perpendicular to the length direction Ld. The height direction Td can be rephrased as a direction perpendicular to the main surface of the circuit board, in the state in which the coil component 1 is mounted on the circuit board, among the directions perpendicular to the length direction Ld.

Figure 4:
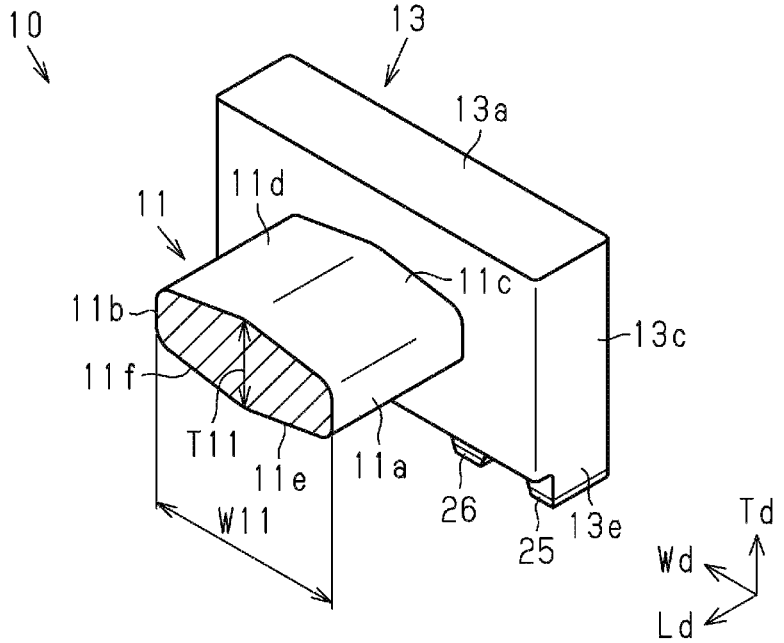
FIG. 4 is a cross-sectional perspective view showing a wiring core portion of the core.

As shown in FIGS. 3 and 4, a dimension L11 in the length direction Ld of the winding core portion 11 is larger than a dimension W11 in the width direction Wd and a dimension T11 in the height direction Td of the winding core portion 11. The dimension W11 in the width direction Wd of the winding core portion 11 is larger than the dimension T11 in the height direction Td of the winding core portion 11. The dimension T11 in the height direction Td of the winding core portion 11 indicates a maximum dimension of the winding core portion 11 in the height direction Td.

As shown in FIG. 4, it is preferable that a cross-sectional shape, of the winding core portion 11, in which the winding core portion 11 is cut by a plane perpendicular to an extending direction of the winding core portion 11, that is, a cross-sectional shape in which the winding core portion 11 is cut by a plane parallel to the height direction Td and the width direction Wd (hereinafter, simply referred to as a cross-sectional shape of the winding core portion 11) is substantially polygonal. In the present embodiment, the cross-sectional shape of the winding core portion 11 is substantially hexagonal. In this specification, examples of a "polygonal shape" include a shape in which a corner portion is chamfered, a shape in which a corner portion is rounded, a shape in which a part of each side is curved, and the like.

The winding core 11 has a pair of side surfaces 11*a* and 11*b* that are two surfaces facing each other in the width direction Wd, and a pair of first surfaces 11*c* and 11*d* and a pair of second surfaces 11*e* and 11*f* that are four surfaces and that face each other in the height direction Td. The side surface 11*a* and the side surface 11*b* are formed so as to be spaced apart from and parallel to each other in the width direction Wd. The first surfaces 11*c* and 11*d* and the second surfaces 11*e* and 11*f* are formed so as to be spaced apart from each other in the height direction Td. An angle formed by the side surface 11*a* and the first surface 11*c*, an angle formed by the side surface 11*a* and the second surface 11*e*, an angle formed by the side surface 11*b* and the first surface 11*d*, and an angle formed by the side surface 11*b* and the second surface 11*f* are mutually equal, for example, about 100 degrees. An angle formed by the first surface 11*c* and the first surface 11*d* and an angle formed by the second surface 11*e* and the second surface 11*f* are equal to each other, for example, about 160 degrees. Note that each of the angle formed by the side surface 11*a* and the first surface 11*c*, the angle formed by the side surface 11*a* and the second surface 11*e*, the angle formed by the side surface 11*b* and the first surface 11*d*, and the angle formed by the side surface 11*b* and the second surface 11*f* can be arbitrarily changed. For example, the angle formed by the side surface 11*a* and the first surface 11*c*, the angle formed by the side surface 11*a* and the second surface 11*e*, the angle formed by the side surface 11*b* and the first surface 11*d*, and the angle formed by the side surface 11*b* and the second surface 11*f* may be mutually different. Additionally, each of the angles formed by the first surface 11*c* and the first surface 11*d* and formed by the second surface 11*e* and the second surface 11*f* can be arbitrarily changed. For example, the angle formed by the first surface 11*c* and the first surface 11*d*, and the angle formed by the second surface 11*e* and the second surface 11*f* may be different from each other.

As shown in FIG. 1 to FIG. 3, a shape of the first flange portion 12 is substantially the same as a shape of the second flange portion 13. The dimensions W12 and W13 of the first flange portion 12 and the second flange portion 13 in the width direction Wd are larger than the dimensions T12 and T13 of the first flange portion 12 and the second flange portion 13 in the height direction Td. The dimensions T12 and T13 of the first flange portion 12 and the second flange portion 13 in the height direction Td are larger than the dimensions L12 and L13 of the first flange portion 12 and the second flange portion 13 in the length direction Ld. The dimensions W12 and W13 in the width direction Wd of the first flange portion 12 and the second flange portion 13 are larger than the dimension W11 in the width direction Wd of the winding core portion 11, and the dimensions T12 and T13 in the height direction Td of the first flange portion 12 and the second flange portion 13 are larger than the dimension T11 in the height direction Td of the winding core portion 11 (refer to FIG. 4). Note that the dimension T12 in the height direction Td of the first flange portion 12 is a dimension in the height direction Td of a portion excluding protrusions 12*e*, 12*f*, 12*g*, and 12*h*, a first terminal electrode 21, a second terminal electrode 22, a third terminal electrode 23, and a fourth terminal electrode 24 which will be described later, from the first flange portion 12. In addition, the dimension T13 in the height direction Td of the second flange portion 13 is a dimension in the height direction Td of a portion excluding protrusions 13*e*, 13*f*, 13*g*, and 13*h*, a fifth terminal electrode 25, a sixth terminal electrode 26, a seventh terminal electrode 27, and an eighth terminal electrode 28 which will be described later from the second flange portion 13.

The first flange portion 12 includes a first surface 12*a* and a second surface 12*b* facing each other in the height direction Td, and a pair of side surfaces 12*c* and 12*d* facing each other in the width direction Wd. Four protrusions 12*e*, 12*f*, 12*g*, and 12*h* protruding from the second surface 12*b* in the height direction Td are provided in the first flange portion 12. The four protrusions 12*e*, 12*f*, 12*g*, and 12*h* are disposed so as to be mutually spaced in the width direction Wd. The first terminal electrode 21 is provided at a tip end portion of the protrusion 12*e*, the second terminal electrode 22 is provided at a tip end portion of the protrusion 12*f*, the third terminal electrode 23 is provided at a tip end portion of the protrusion 12*g*, and the fourth terminal electrode 24 is provided at a tip portion of the protrusion 12*h*. A shape of each of the terminal electrodes 21 to 24 in a plan view is a substantially rectangular shape in which a dimension thereof in the length direction Ld is larger than a dimension thereof in the width direction Wd. As for the terminal electrodes 21 to 24, the first terminal electrode 21, the second terminal electrode 22, the third terminal electrode 23, and the fourth terminal electrode 24 are disposed from the side surface 12*c* toward the side surface 12*d*, in this order. The first terminal electrode 21 and the fourth terminal electrode 24 are provided at end portions in the width direction Wd of the first flange portion 12. Inner end edges in the width direction Wd of the first terminal electrode 21 and the fourth terminal electrode 24 are positioned at outer side portions of the winding core portion 11 in the width direction Wd. A distance between the second terminal electrode 22 and the third terminal electrode 23 in the width direction Wd is larger than each of a distance between the first terminal electrode 21 and the second terminal electrode 22 in the width direction Wd and a distance between the third terminal electrode 23 and the fourth terminal electrode 24 in the width direction Wd.

The second flange portion 13 includes a first surface 13*a* and a second surface 13*b* facing each other in the height direction Td, and a pair of side surfaces 13*c* and 13*d* facing each other in the width direction Wd. Four protrusions 13*e*, 13*f*, 13*g*, and 13*h* protruding from the second surface 13*b* in the height direction Td are provided in the second flange portion 13. The four protrusions 13*e*, 13*f*, 13*g*, and 13*h* are disposed so as to be spaced in the width direction Wd. The fifth terminal electrode 25 is provided at a tip end portion of the protrusion 13*e*, the sixth terminal electrode 26 is provided at a tip end portion of the protrusion 13*f*, the seventh terminal electrode 27 is provided at a tip end portion of the protrusion 13*g*, and the eighth terminal electrode 28 is provided at a tip end portion of the protrusion 13*h*. A shape of each of the terminal electrodes 25 to 28 in a plan view is a substantially rectangular shape in which a dimension thereof in the length direction Ld is larger than a dimension thereof in the width direction Wd. As for each of the terminal electrodes 25 to 28, the fifth terminal electrode 25, the sixth terminal electrode 26, the seventh terminal electrode 27, and the eighth terminal electrode 28 are disposed from the side surface 13*c* toward the side surface 13*d*, in this order. The fifth terminal electrode 25 and the eighth terminal electrode 28 are provided at end portions in the width direction Wd of the second flange portion 13. Inner end edges in the width direction Wd of the fifth terminal electrode 25 and the eighth terminal electrode 28 are positioned at outer side portions of the winding core portion 11 in the width direction Wd. A distance between the sixth terminal electrode 26 and the seventh terminal electrode 27 in the width direction Wd is larger than each of a distance between the fifth terminal electrode 25 and the sixth terminal electrode 26 in the width direction Wd and a distance between the seventh terminal electrode 27 and the eighth terminal electrode 28 in the width direction Wd.

Each of the terminal electrodes 21 to 28 is formed by coating and baking a conductive paste containing silver (Ag) as a conductive component or by sputtering nickel (Ni)-chromium (Cr), nickel (Ni)-copper (Cu) or the like. Additionally, a plated film may be further formed as needed. As a material for the plated film, for example, a metal such as tin (Sn), Cu, Ni, or the like, or an alloy such as Ni—Sn may be used. Alternatively, the plated film may have a multilayer structure.

As shown in FIG. 1 and FIG. 2, a plate member 40 having a substantially rectangular parallelepiped shape is attached to the core 10 of the present embodiment. The plate member 40 is provided so as to connect the first surface 12*a* of the first flange portion 12 to the first surface 13*a* of the second flange portion 13. Incidentally, the plate member 40 may be omitted. The plate member 40 is made of a non-conductive material, and in particular, a non-magnetic material such as alumina, a magnetic material such as nickel (Ni)-zinc (Zn) ferrite, or the like. The core 10 is formed, for example, by firing a molded body obtained by compressing a non-conductive material. The plate member 40 is not limited to a member formed by firing a molded body obtained by compressing a non-conductive material, and may be formed, for example, by thermally curing resin containing magnetic powder such as metal powder, ferrite powder, or the like, resin containing non-magnetic powder such as silica powder, or resin containing no filler.

An outer surface of the plate member 40 having a substantially rectangular parallelepiped shape serves as an attraction surface when the coil component 1 is moved. For this reason, for example, when the coil component 1 is mounted on the circuit board, the coil component 1 can be easily moved onto the circuit board by an attraction-conveying device. Similarly to the core 10, the plate member 40 may be made of a magnetic material, and when the plate member 40 is made of a magnetic material, the core 10 can cooperate with the plate member 40 to form a closed magnetic circuit, thereby improving efficiency of obtaining inductance.

As shown in FIGS. 1 and 2, the coil 30 includes a first wire 31, a second wire 32, a third wire 33, and a fourth wire 34. The respective wires 31 to 34 are wound around the winding core portion 11 of the core 10.

The coil 30 includes a winding portion 30*a* wound around the winding core portion 11, and connection portions 30*b* and 30*c* on both sides of the winding portion 30*a* in the length direction Ld. The winding portion 30*a* is a portion where the respective wires 31 to 34 are wound around the winding core portion 11. The connection portions 30*b* and 30*c* include end portions and vicinities thereof which are connected to the respective terminal electrodes 21 to 24 of the first flange portion 12 and the respective terminal electrodes 25 to 28 of the second flange portion 13 in the respective wires 31 to 34. In addition, in the winding portion 30*a*, the number of winding (the number of turns) of the first wire 31, the number of winding (the number of turns) of the second wire 32, the number of winding (the number of turns) of the third wire 33, and the number of winding (the number of turns) of the fourth wire 34 are mutually equal.

The winding portion 30*a* includes a twisted wire portion 35 in which the respective wires 31 to 34 are collectively twisted. In this embodiment, the winding portion 30*a* is formed with the twisted wire portion 35 in which the respective wires 31 to 34 are collectively twisted a plurality of times. In the twisted wire portion 35, the twist number of the first wire 31, the twist number of the second wire 32, the twist number of the third wire 33, and the twist number of the fourth wire 34 are mutually equal. Therefore, in the winding portion 30*a*, a total of the twist number of the first wire 31, a total of the twist number of the second wire 32, a total of the twist number of the third wire 33, and a total of the twist number of the fourth wire 34 are mutually equal. The twist number of the first wire 31 in the twisted wire portion 35 is the number of times that the first wire 31 is twisted with the second wire 32, the third wire 33, and the fourth wire 34 in one twisted wire portion 35. The twist number of the second wire 32 in the twisted wire portion 35 is the number of times that the second wire 32 is twisted with the first wire 31, the third wire 33, and the fourth wire 34 in one twisted wire portion 35. The twist number of the third wire 33 in the twisted wire portion 35 is the number of times that the third wire 33 is twisted with the first wire 31, the second wire 32, and the fourth wire 34 in one twisted wire portion 35. The twist number of the fourth wire 34 in the twisted wire portion 35 is the number of times that the fourth wire 34 is twisted with the first wire 31, the second wire 32, and the third wire 33 in one twisted wire portion 35.

Additionally, all twisting directions of the twisted wire portion 35 in the winding portion 30*a* are the same direction. In other words, the twisting directions of the twisted wire portion 35 are unified by either S-twist (right direction) or Z-twist (left direction). In one example, the entire twisted wire portion 35 is formed by the S-twist. In this case, positional relationships among the first wire 31, the second wire 32, the third wire 33, and the fourth wire 34 in the entire twisted wire portion 35 are constant. In this embodiment, in a view from a vertical direction with respect to a peripheral surface of the winding core portion 11, the first wire 31 and the second wire 32 are positioned in an outer side portion and the third wire 33 and the fourth wire 34 are positioned in an inner side portion in a state in which the respective wires 31 to 34 are arranged in the length direction Ld. In a state in which the respective wires 31 to 34 are arranged in the length direction Ld when viewed from the vertical direction with respect to the peripheral surface of the winding core portion 11, the first wire 31 is adjacent to the third wire 33, and the second wire 32 is adjacent to the fourth wire 34. In this manner, in the winding portion 30*a*, relationships where the first wire 31 is adjacent to the third wire 33, and the second wire 32 is adjacent to the fourth wire 34 are maintained. Note that the entire twisted wire portion 35 may be formed by the Z-twisting.

In this embodiment, by collectively twisting the respective wires 31 to 34, in the winding portion 30*a*, a first portion in a state where the respective wires 31 to 34 are overlapped one another when viewed from the vertical direction with respect to the peripheral surface of the winding core portion 11, and a second portion in a state where the respective wires 31 to 34 are arranged when viewed from the vertical direction with respect to the peripheral surface of the winding core portion 11 are alternately formed in a circumferential surface of the winding core portion 11. In the following description, the first portion is defined as a nodal portion 36, and the second portion is defined as an antinodal portion 37. The nodal portion 36 of the present embodiment is a portion where the respective wires 31 to 34 are arranged in the vertical direction with respect to the peripheral surface of the winding core portion 11. The antinodal portion 37 of the present embodiment is a portion where the respective wires 31 to 34 are overlapped one another in a direction parallel to the surface direction of the peripheral surface of the winding core portion 11. For the sake of convenience, in FIG. 1, the nodal portions 36 on the first surfaces 11*c* and 11*d* of the winding core portion 11 and the nodal portions 36 on the second surfaces 11*e* and 11*f* are omitted. In FIG. 2, the nodal portions 36 on the side surfaces 11*a* and 11*b* of the winding core portion 11 are omitted.

Figure 5:
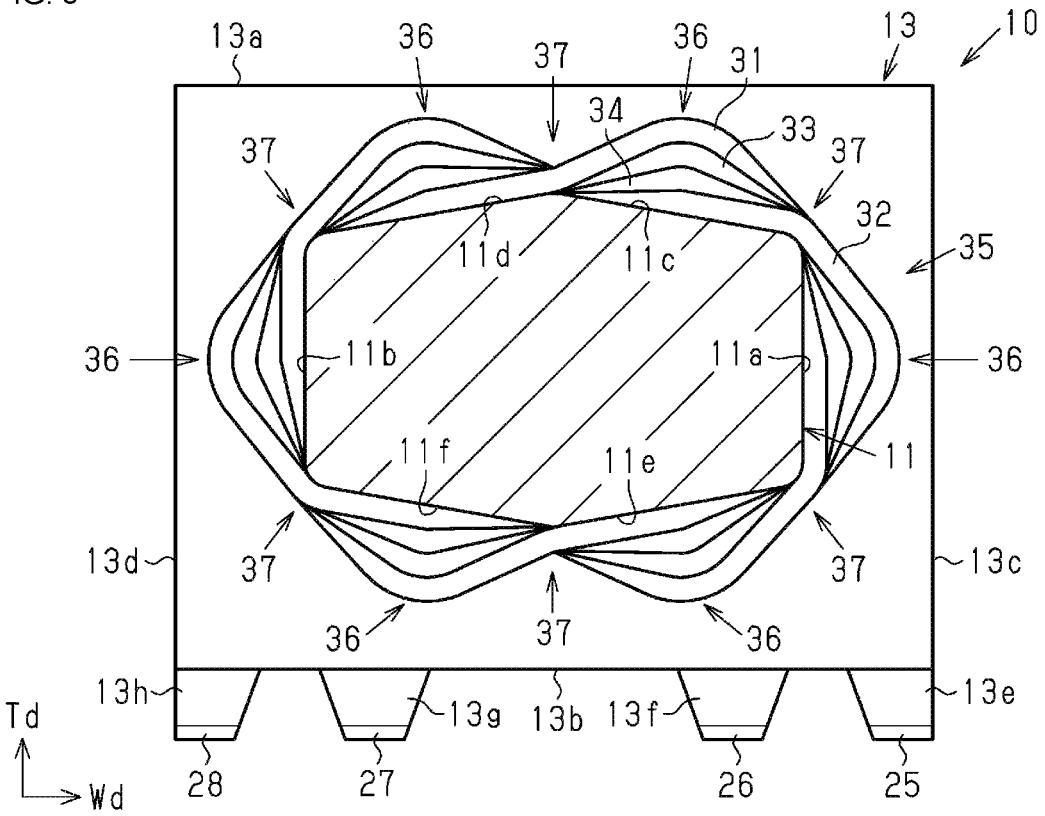
FIG. 5 is a schematic cross-sectional view showing the winding core portion and one turn of a coil.

FIG. 5 is a cross-sectional view taken along a plane perpendicular to the length direction Ld of the winding core portion 11 of the coil component 1, and shows a state in which the respective wires 31 to 34 are wound around the winding core portion 11. In FIG. 5, one turn of the coil 30 is shown.

As shown in FIG. 5, the twisted wire portion 35 of the winding portion 30*a* of the present embodiment is configured such that one nodal portion 36 is disposed on each of the side surfaces 11*a* and 11*b*, the first surfaces 11*c* and 11*d*, and the second surfaces 11*e* and 11*f* which configure the circumferential surface of the winding core portion 11 in the one turn of the coil 30. In addition, the twisted wire portion 35 of the winding portion 30*a* is configured such that the antinodal portion 37 is disposed at a ridge portion between each two surfaces of the side surfaces 11*a* and 11*b*, the first surfaces 11*c* and 11*d*, and the second surfaces 11*e* and 11*f* of the core portion 11 in the one turn. In the antinodal portion 37, the respective wires 31 to 34 are in contact with the winding core portion 11, with respect to each peripheral surface of the winding core portion 11. Therefore, the respective wires 31 to 34 are stably wound around the winding core portion 11, so that winding collapse does not occur. Here, one twisted wire portion 35 is defined by two adjacent antinodal portions 37 in a winding direction of the respective wires 31 to 34, for example.

Additionally, in a cross section taken along a plane perpendicular to the length direction Ld of the winding core portion 11, lengths of respective sides configuring the cross section of the winding core portion 11 are equal to one another. Since the nodal portions 36 of the twisted wire portion 35 are arranged on the side surfaces 11*a* and 11*b*, the first surfaces 11*c* and 11*d*, and the second surfaces 11*e* and 11*f* of the winding core portion 11, intervals (pitches) between the adjacent nodal portions 36 are the same in a winding direction of the coil 30 in the one turn of the coil 30.

As shown in FIG. 1 and FIG. 2, in each of the second surfaces 11*e* and 11*f* of the winding core portion 11 of the present embodiment, the nodal portions 36 adjacent to each other in the length direction Ld of the twisted wire portion 35 are arranged along the length direction Ld. In addition, in the side surface 11*a* of the winding core portion 11, the nodal portions 36 adjacent to each other in the length direction Ld of the twisted wire portion 35 are arranged along the length direction Ld. Although not shown in the figure, in the first surfaces 11*c* and 11*d* and the side surface 11*b*, the nodal portions 36 adjacent to each other in the length direction Ld of the twisted wire portion 35 are similarly arranged along the length direction Ld.

The wires 31 to 34 are connected to the second terminal electrode 22, the fourth terminal electrode 24, the fifth terminal electrode 25, and the seventh terminal electrode 27, respectively, by thermal pressure bonding, brazing, welding, or the like, for example.

The first wire 31 has one end portion 31*a* and the other end portion 31*b*. The one end portion 31*a* of the first wire 31 is included in a connection portion 30*b*, and the other end portion 31*b* is included in a connection portion 30*c*. In this embodiment, the one end portion 31*a* of the first wire 31 configures an end portion of winding-start of the first wire 31, and the other end portion 31*b* of the first wire 31 configures an end portion of winding-end of the first wire 31. The one end portion 31*a* of the first wire 31 is connected to the first terminal electrode 21 of the first flange portion 12. The other end portion 31*b* of the first wire 31 is connected to the fifth terminal electrode 25 of the second flange portion 13.

The second wire 32 has one end portion 32*a* and the other end portion 32*b*. The one end portion 32*a* of the second wire 32 is included in the connection portion 30*b*, and the other end portion 32*b* is included in the connection portion 30*c*. In this embodiment, the one end portion 32*a* of the second wire 32 configures an end portion of winding-start of the second wire 32, and the other end portion 32*b* of the second wire 32 configures an end portion of winding-end of the second wire 32. The one end portion 32*a* of the second wire 32 is connected to the fourth terminal electrode 24 of the first flange portion 12. The other end portion 32*b* of the second wire 32 is connected to the eighth terminal electrode 28 of the second flange portion 13.

The third wire 33 has one end portion 33*a* and the other end portion 33*b*. The one end portion 33*a* of the third wire 33 is included in the connection portion 30*b*, and the other end portion 33*b* is included in the connection portion 30*c*. In this embodiment, the one end portion 33*a* of the third wire 33 configures an end portion of winding-start of the third wire 33, and the other end portion 33*b* of the third wire 33 configures an end portion of winding-end of the third wire 33. The one end portion 33*a* of the third wire 33 is connected to the second terminal electrode 22 of the first flange portion 12. The other end portion 33*b* of the third wire 33 is connected to the sixth terminal electrode 26 of the second flange portion 13.

The fourth wire 34 has one end portion 34*a* and the other end portion 34*b*. The one end portion 34*a* of the fourth wire 34 is included in the connection portion 30*b*, and the other end portion 34*b* is included in the connection portion 30*c*. In this embodiment, one end portion 34*a* of the fourth wire 34 configures an end portion of winding-start of the fourth wire 34, and the other end portion 34*b* of the fourth wire 34 configures an end portion of winding-end of the fourth wire 34. The one end portion 34*a* of the fourth wire 34 is connected to the third terminal electrode 23 of the first flange portion 12. The other end portion 34*b* of the fourth wire 34 is connected to the seventh terminal electrode 27 of the second flange portion 13.

Each of wires 31 to 34 is configured with a conductive wire of a good conductor such as copper (Cu), silver (Ag), gold (Au), or the like, and an insulating film, such as polyurethane, polyamide-imide, fluorine resin, or the like, which covers the conductive wire. Therefore, in the winding portion 30*a*, the first wire 31, the second wire 32, the third wire 33, and the fourth wire 34 are electrically insulated from one another.

When the coil component 1 is mounted on a circuit board PX, the respective terminal electrodes 21 to 28 face a main surface of the circuit board PX. In this case, the winding core portion 11 is parallel to the main surface of the circuit board PX. That is, the coil 30 of the present embodiment is formed as a coil of a lateral winding structure (horizontal type) in which a winding shaft of the first wire 31, the second wire 32, the third wire 33, and the fourth wire 34 is parallel to the main surface of the circuit board PX.

Figure 6:
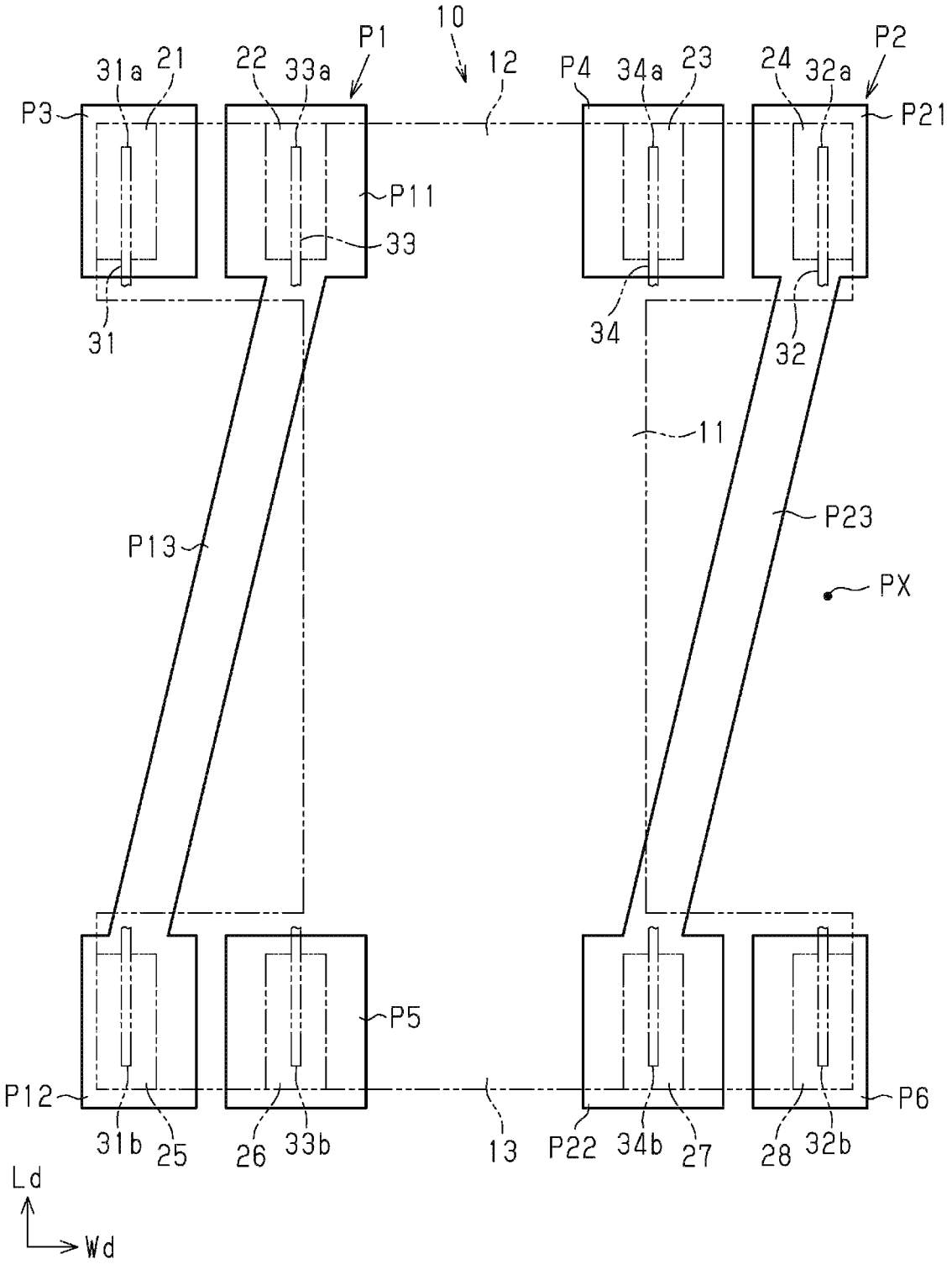
FIG. 6 is a schematic plan view showing a wiring pattern of a circuit board on which the coil component is mounted.

As shown in FIG. 6, the coil component 1 is mounted on the circuit board PX. The circuit board PX includes a first wiring pattern P1, a second wiring pattern P2, a third wiring pattern P3, a fourth wiring pattern P4, a fifth wiring pattern P5, and a sixth wiring pattern P6. Each of the third wiring pattern P3, the fourth wiring pattern P4, the fifth wiring pattern P5, and the sixth wiring pattern P6 is formed in a substantially rectangular shape in which the length direction Ld is longer than the width direction Wd. The first wiring pattern P1 includes a first land portion P11, a second land portion P12, and a connection wiring portion P13 connecting the first land portion P11 and the second land portion P12. The second wiring pattern P2 includes a first land portion P21, a second land portion P22, and a connection wiring portion P23 connecting the first land portion P21 and the second land portion P22. In this embodiment, each of the first wiring pattern P1 and the second wiring pattern P2 configures a ground pattern.

The first land portion P11 of the first wiring pattern P1, the second land portion P21 of the first wiring pattern P2, the third wiring pattern P3, and the fourth wiring pattern P4 are disposed at the same position in the length direction Ld, and are arranged at intervals in the width direction Wd. The second land portion P12 of the first wiring pattern P1, the second land portion P22 of the second wiring pattern P2, the fifth wiring pattern P5, and the sixth wiring pattern P6 are disposed at the same position in the length direction Ld and are arranged at intervals in the width direction Wd. The first land portion P11 of the first wiring pattern P1, the first land portion P21 of the second wiring pattern P2, the third wiring pattern P3, and the fourth wiring pattern P4 are disposed at intervals from the second land portion P12 of the first wiring pattern P1, the second land portion P22 of the second wiring pattern P2, the fourth wiring pattern P4, the fifth wiring pattern P5, and the sixth wiring pattern P6 in the length direction Ld.

When the coil component 1 of the present embodiment is mounted on a circuit board, the other end portion 31*b* of the first wire 31 is electrically connected to the one end portion 33*a* of the third wire 33, and the one end portion 32*a* of the second wire 32 is electrically connected to the other end portion 34*b* of the fourth wire 34. Specifically, the first land portion P11 of the first wiring pattern P1 of the circuit board PX is electrically connected to the one end portion 33*a* (the second terminal electrode 22) of the third wire 33. The first land portion P21 of the second wiring pattern P2 of the circuit board PX is electrically connected to the one end portion 32*a* (the fourth terminal electrode 24) of the second wire 32. The third wiring pattern P3 of the circuit board PX is electrically connected to the one end portion 31*a* (the first terminal electrode 21) of the first wire 31. The fourth wiring pattern P4 of the circuit board PX is electrically connected to the one end portion 34*a* (the third terminal electrode 23) of the fourth wire 34. The second land portion P12 of the first wiring pattern P1 of the circuit board PX is electrically connected to the other end portion 31*b* (the fifth terminal electrode 25) of the first wire 31. That is, the first wiring pattern P1 electrically connects the other end portion 31*b* of the first wire 31 and the one end portion 33*a* of the third wire 33. The fifth wiring pattern P5 of the circuit board PX is electrically connected to the other end portion 33*b* (the sixth terminal electrode 26) of the third wire 33. The second land portion P22 of the second wiring pattern P2 of the circuit board PX is electrically connected to the other end portion 34*b* (the seventh terminal electrode 27) of the fourth wire 34. That is, the second wiring pattern P2 electrically connects the other end portion 32*b* of the second wire 32 and the one end portion 34*a* of the fourth wire 34. The sixth wiring pattern P6 of the circuit board PX is electrically connected to the other end portion 32*b* (the eighth terminal electrode 28) of the second wire 32.

Figure 7:
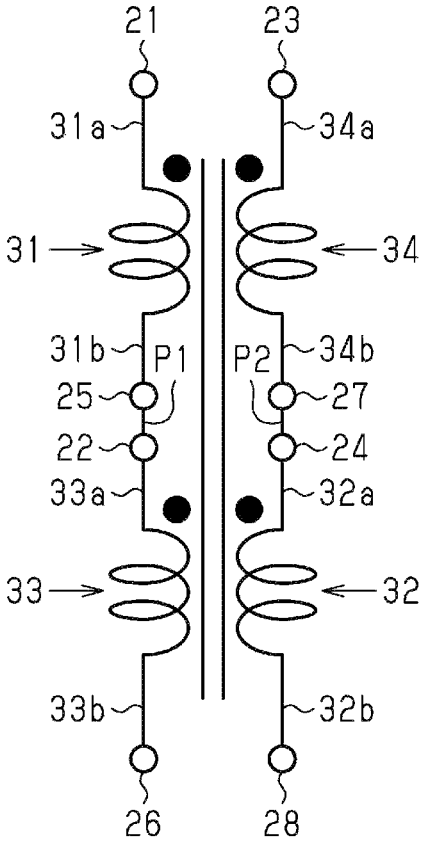
FIG. 7 is an explanatory diagram showing a circuit configuration of the coil component according to the one embodiment.

In this manner, in the present embodiment, the coil component 1 is mounted on the circuit board PX, thereby forming an equivalent circuit of the coil component 1 which is used as a signal transformer as shown in FIG. 7.

The first terminal electrode 21 to which the one end portion 31*a* of the first wire 31 is connected configures an input plus side terminal of a balanced circuit, and the sixth terminal electrode 26 to which the other end portion 33*b* of the third wire 33 is connected configures an input minus side terminal of the balanced circuit. The third terminal electrode 23 to which the one end portion 34*a* of the fourth wire 34 is connected configures an output plus side terminal of the balanced circuit, and the eighth terminal electrode 28 to which the other end portion 32*b* of the second wire 32 is connected configures an output minus side terminal of the balanced circuit. The first wire 31 and the third wire 33 configure a primary side winding of the signal transformer, and the second wire 32 and the fourth wire 34 configure a secondary side winding of the signal transformer. A first center tap is configured with the fifth terminal electrode 25 to which the other end portion 31*b* of the first wire 31 is connected and the second terminal electrode 22 to which the one end portion 33*a* of the third wire 33 is connected. A second center tap is configured with the seventh terminal electrode 27 to which the other end portion 34*b* of the fourth wire 34 is connected and the fourth terminal electrode 24 to which the one end portion 32*a* of the second wire 32 is connected.

Next, a winding method of the respective wires 31 to 34 will be described.

Figure 8A:
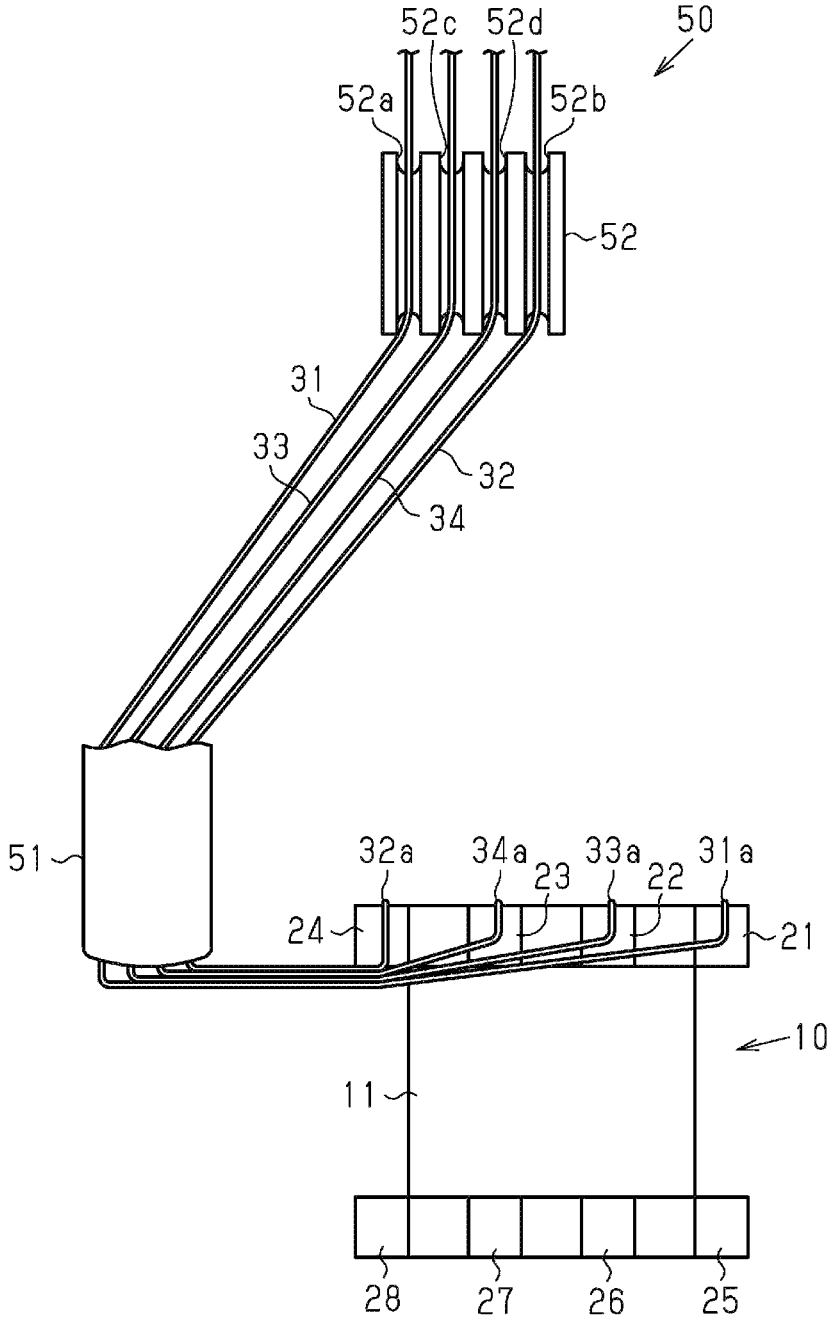
FIG. 8A is an explanatory diagram of a main portion of a winding device for winding a wire around the core.

FIG. 8A shows a main portion of a winding device 50 for winding the first wire 31 and the second wire 32 around the core 10.

Figure 8B:
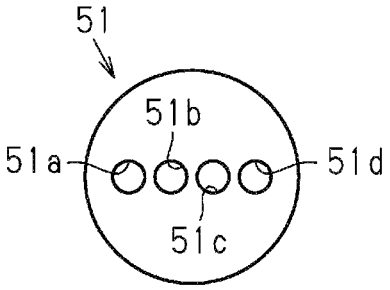
FIG. 8B is a front view of a nozzle of the winding device.

First, the first wire 31, the second wire 32, the third wire 33, and the fourth wire 34 are sequentially passed through groove portions 52*a*, 52*b*, 52*c*, and 52*d* of a tensioner 52 and a nozzle 51, and a tip end of each of wires 31 to 34 is connected to the core 10. As shown in FIG. 8B, the nozzle 51 has four nozzle holes 51*a* to 51*d*. For example, the nozzle hole 51*a* is a hole through which the first wire 31 is passed, the nozzle hole 51*b* is a hole through which the second wire 32 is passed, the nozzle hole 51*c* is a hole through which the third wire 33 is passed, and the nozzle hole 51*d* is a hole through which the fourth wire 34 is passed. As shown in FIG. 8B, the nozzle holes 51*a* to 51*d* are provided in the nozzle 51 so as to be arranged in a line in a predetermined direction. Each of wires 31 to 34 is pulled out from a coil bobbin (not shown). The groove portion 52*a* of the tensioner 52 applies tension to the first wire 31, the groove portion 52*b* applies tension to the second wire 32, the groove portion 52*c* applies tension to the third wire 33, and the groove portion 52*d* applies tension to the fourth wire 34.

Next, as shown in FIG. 8A, the winding device 50 revolves the nozzle 51 around the core 10, and winds the wires 31 to 34 around the winding core portion 11 of the core 10 while twisting the wires 31 to 34. As a result, the twisted wire portion 35 is formed. According to a revolution direction of the nozzle 51, the respective wires 31 to 34 can be twisted in S-twist or Z-twist.

Then, the winding device 50 rotates the core 10 in the same direction as the revolution direction of the nozzle 51 while revolving the nozzle 51 around the core 10. When the winding device 50 does not rotate the core 10, the respective wires 31 to 34 have the twist number of "1", in other words, form two nodal portions 36, to be wound around the winding core portion 11 of the core 10, by the revolution of the nozzle 51. Therefore, by adjusting a revolution speed of the nozzle 51 and a rotation speed of the core 10 by the winding device 50, the twist number per unit turn and a twist pitch of each of the wires 31 to 34 can be set.

The operation of the present embodiment will be described.

As a result of studying an insertion loss of a coil component, the inventor of the present disclosure has found the following two points. A first point is that an insertion loss of a coil component increases as leakage inductance of a coil of the coil component increases. A second point is that when a coil is configured by using two sets of configurations in which two wires that are a primary side wire and a secondary side wire are twisted, as a difference between stray capacitance between the specific primary and secondary side wires and stray capacitance between the other primary and secondary side wires increases, an insertion loss of a coil component increases. Furthermore, as for the above-described difference in stray capacitance, the inventor has found that as a difference between a length (hereinafter referred to as "first length") of a portion of the first wire 31 and the second wire 32 that are wound around the winding core portion 11 such that the first wire 31 and the second wire 32 are adjacent to each other, and a length (hereinafter referred to as "second length") of a portion of the third wire 33 and the fourth wire 34 that are wound such that the third wire 33 and the fourth wire 34 are adjacent to each other increases, the insertion loss increases.

For example, it is assumed that the first wire and the second wire are wound around the winding core portion 11 by bifilar winding, and the third wire and the fourth wire are wound around an outer side portion of a portion where the first wire and the second wire are wound around the winding core portion 11, by bifilar winding. In this case, a length of one turn which are wound such that the third wire and the fourth wire are adjacent to each other is longer than a length of one turn which is wound around the winding core 11 such that the first wire and the second wire are adjacent to each other. Therefore, in order to make the first length and the second length equal to each other, it is necessary that the turn number (hereinafter referred to as the "second turn number") of the portion where the third wire and the fourth wire are wound in such a manner that the third wire and the fourth wire are adjacent to each other from above the first wire and the second wire is smaller than the turn number (hereinafter referred to as the "first turn number") of the portion where the first wire and the second wire are wound around the winding core portion 11 in such a manner that the first wire and the second wire are adjacent to each other. However, when the second turn number is made smaller than the first turn number, a potential difference is generated in the two center taps of the coil component, so that ability to suppress noise in the coil component is reduced.

In view of these circumstances, the inventor of the present disclosure has adopted a configuration in which the respective wires 31 to 34 form the twisted wire portion 35 as measures for reducing the insertion loss. Since the respective wires 31 to 34 are twisted, impedance can be reduced in a higher frequency band as compared with a case where the respective wires 31 to 34 are wound around the winding core portion 11 by tetrafilar winding (four parallel winding), so that leakage inductance of each of wires 31 to 34 can be reduced.

In addition, the inventor of the present disclosure has adopted a configuration in which the lengths of the wires 31 to 34 wound around the winding core portion 11 of the core 10 are equal to one another. More specifically, the inventor of the present disclosure has adopted a configuration in which all twisting directions of the twisted wire portion 35 are the same. Thus, the length of the first wire 31 and the length of the second wire 32 wound around the winding core portion 11 and the length of the third wire 33 and the length of the fourth wire 34 wound around the winding core portion 11 are made equal to one another without changing the turn number of the first wire 31 and the second wire 32, and the turn number of the third wire 33 and the fourth wire 34. Therefore, the turn number of the first wire 31 and the second wire 32 can be made equal to the turn number of the third wire 33 and the fourth wire 34, so that the potential difference between the two center taps can be made close to zero or can be made to be zero. Therefore, when the two center taps are connected to the ground, a common mode current flows into the ground, so that noise of the coil component 1 can be reduced. As a result, both the insertion loss and the noise of the coil component 1 can be reduced.

The effects of the present embodiment will be described.

1. The coil 30 of the coil component 1 has the twisted wire portion 35 in which the first wire 31, the second wire 32, the third wire 33, and the fourth wire 34 are collectively twisted. According to this configuration, leakage inductance among the respective wires 31 to 34 is reduced. Further, for example, as compared to the configuration in which the first wire 31 and the second wire 32 are wound around the winding core portion 11, and the third wire 33 and the fourth wire 34 are wound from above the first wire 31 and the second wire 32, variation among the length of the first wire 31 wound around the winding core portion 11, the length of the second wire 32 wound around the winding core portion 11, and the length of the third wire 33 wound around the winding core portion 11 and the length of the fourth wire 34 wound around the winding core portion 11 is reduced. Thus, a difference in stray capacitance among the respective wires 31 to 34 is reduced. As described above, the difference in stray capacitance and the leakage inductance are reduced, so that the insertion loss in an entire frequency band is reduced. Therefore, it is possible to enhance versatility of the coil component 1 with respect to a communication band.

2. In the winding portion 30*a*, the total number of times where the first wire 31 is twisted into the second wire 32, the third wire 33, and the fourth wire 34, the total number of times where the second wire 32 is twisted into the first wire 31, the third wire 33, and the fourth wire 34, the total number of times where the third wire 33 is twisted into the first wire 31, the second wire 32, and the fourth wire 34, and the total number of times where the fourth wire 34 is twisted into the first wire 31, the second wire 32, and the third wire 33 are mutually equal. According to this configuration, the variation among the length of the first wire 31 wound around the winding core portion 11, the length of the second wire 32 wound around the winding core portion 11, the length of the third wire 33 wound around the winding core portion 11, and the length of the fourth wire 34 wound around the winding core portion 11 is further reduced. Thus, the stray capacitance among the respective wires 31 to 34 is reduced, so that variation in stray capacitance among the respective wires 31 to 34 is reduced. Therefore, the insertion loss can be reduced in the entire frequency band.

3. All the twisting directions of the twisted wire portion 35 are the same direction. According to this configuration, the variation among the length of the first wire 31 wound around the winding core portion 11, the length of the second wire 32 wound around the winding core portion 11, the length of the third wire 33 wound around the winding core portion 11, and the length of the fourth wire 34 wound around the winding core portion 11 is further reduced. Thus, the stray capacitance among the respective wires 31 to 34 is reduced, so that the variation in stray capacitance among the respective wires 31 to 34 is reduced. Therefore, the insertion loss can be reduced in the entire frequency band.

4. Positional relationships among the first wire 31, the second wire 32, the third wire 33, and the fourth wire 34 in the twisted wire portion 35 are constant. According to this configuration, the twisted wire portion 35 can be easily formed.

5. In a view from a direction perpendicular to the peripheral surface of the winding core portion 11 of the core 10, the antinodal portion 37 in the twisted wire portion 35 is disposed at a corner portion (ridge portion) of the winding core portion 11. According to this configuration, it is possible to suppress winding collapse of the respective wires 31 to 34.

6. A distance between the second terminal electrode 22 and the third terminal electrode 23 in the width direction Wd is larger than each of a distance between the first terminal electrode 21 and the second terminal electrode 22 in the width direction Wd and a distance between the third terminal electrode 23 and the fourth terminal electrode 24 in the width direction Wd. A distance between the sixth terminal electrode 26 and the seventh terminal electrode 27 in the width direction Wd is larger than each of a distance between the fifth terminal electrode 25 and the sixth terminal electrode 26 in the width direction Wd and a distance between the seventh terminal electrode 27 and the eighth terminal electrode 28 in the width direction Wd. According to this configuration, a distance between the one end portion 32*a* of the second wire 32 and the other end portion 33*b* of the third wire 33 in the width direction Wd increases, and a distance between the other end portion 31*b* of the first wire 31 and the one end portion 34*a* of the fourth wire 34 increases. Therefore, an insulation distance between the primary side winding and the secondary side winding of the transformer which is configured by mounting the coil component 1 on the circuit board PX can be ensured.

Modification

The above embodiment is an example of possible forms of coil components related to the present disclosure and is not intended to limit the form thereof. The coil components related to the present disclosure may take a different form from the form exemplified in the above embodiment. One example is a form in which a part of the configuration of the above embodiment is replaced, changed or omitted, or a form in which a new configuration is added to the above embodiment. In the following modifications, the same reference signs as those in the above embodiment are assigned to portions common to the form of the above embodiment, and descriptions thereof will be omitted.

In the above embodiment, the respective wires 31 to 34 are wound around the winding core portion 11 by one layer, but the present disclosure is not limited thereto. The respective wires 31 to 34 may be wound around the winding core portion 11 by a plurality of layers by winding the respective wires 31 to 34 on the respective wires 31 to 34 wound around the winding core portion 11.

In the above embodiment and the above modification, a range in which the twisted wire portion 35 formed of the wires 31 to 34 are formed is not limited to all portions where the respective wires 31 to 34 are wound around the winding core portion 11, and the range may be arbitrarily changed. In one example, a part of the respective wires 31 to 34 wound around the winding core portion 11 may be form by tetrafilar winding. In short, it is sufficient to form the twisted wire portion 35 by at least part of a portion wound around the winding core portion 11 in the respective wires 31 to 34.

In the above embodiment and the above modification, the number of the twisted wire portions 35 is not limited to one, and may be arbitrarily changed. For example, the number of the twisted wire portions 35 may be equal to or more than two.

In the above embodiment and the above modification, the number of nodal portions 36 of the twisted wire portion 35 can be arbitrarily changed.

For example, a plurality of nodal portions 36 of the twisted wire portion 35 may be formed on the side surfaces 11*a* and 11*b* of the winding core portion 11 in the one turn of the coil 30. For example, the number of nodal portions 36 of the twisted wire portion 35 on the side surface 11*a* of the winding core portion 11 may be different from the number of nodal portions 36 on the side surface 11*b* in the one turn of the coil 30. For example, the nodal portion 36 of the twisted wire portion 35 may not be formed on at least one of the side surface 11*a* and the side surface 11*b* of the winding core portion 11 in the one turn of the coil 30.

For example, one, or three or more nodal portions 36 of the twisted wire portion 35 may be formed on the first surfaces 11*c* and 11*d* of the winding core portion 11 in the one turn of the coil 30. For example, one, or three or more nodal portions 36 of the twisted wire portion 35 may be formed on the second surfaces 11*e* and 11*f* of the winding core portion 11 in the one turn of the coil 30. Further, for example, the number of nodal portions 36 of the twisted wire portion 35 on the first surfaces 11*c* and 11*d* of the winding core portion 11 may be different from the number of nodal portions 36 on the second surfaces 11*e* and 11*f* in the one turn of the coil 30. Additionally, for example, the nodal portion 36 of the twisted wire portion 35 may not be formed on the first surfaces 11*c* and 11*d* of the winding core portion 11. Moreover, for example, the nodal portion 36 of the twisted wire portion 35 may not be formed on the second surfaces 11*e* and 11*f* of the winding core portion 11.

In the above embodiment, the intervals (pitches) between adjacent nodal portions 36 in the length direction of the twisted wire portion 35 configured with the respective wires 31 to 34 may be mutually equal, but may be unequal.

In the above embodiment and the above modification, at least one of the nodal portions 36 of the twisted wire portion 35 configured with the respective wires 31 to 34 may be disposed at the ridge portion of the winding core portion 11.

Figure 9A:
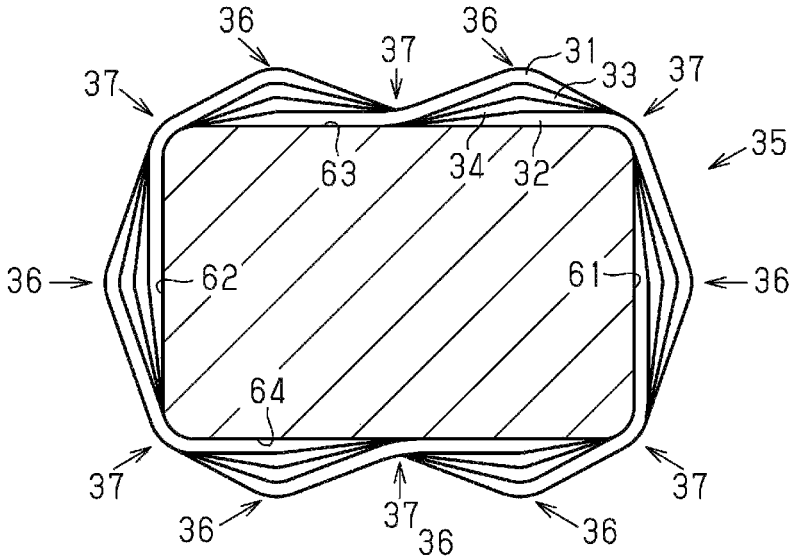

In the above embodiment, the cross-sectional shape of the winging core portion 11 of the core 10 is not limited to the hexagonal shape, and may be arbitrarily changed. For example, the cross-sectional shape of the winding core portion 11 may be a substantially quadrangular shape, a pentagonal shape, or an octagonal shape. For example, as shown in FIG. 9A, the winding core portion 11 has a substantially quadrangular cross-sectional shape, and includes side surfaces 61 and 62, and a first surface 63 and a second surface 64 that are parallel to each other and that configure the peripheral surface of the winding core portion 11. The twisted wire portion 35 configured with the respective wires 31 to 34 wound around the winding core portion 11 has six nodal portions 36 in one turn of the coil 30. As shown in FIG. 9A, in the twisted wire portion 35, one nodal portion 36 is disposed on each of the side surfaces 61 and 62, and two nodal portions 36 are disposed on each of the first surface 63 and the second surface 64. The number of the twisted wire portions 35 can be arbitrarily changed. In the twisted wire portion 35, one nodal portion 36 may be disposed on each of the first surface 63 and the second surface 64, for example. Also, for example, the number of nodal portions 36 of the twisted wire portion 35 disposed on the first surface 63 may be different from the number of nodal portions 36 disposed on the second surface 64.

Figure 9B:
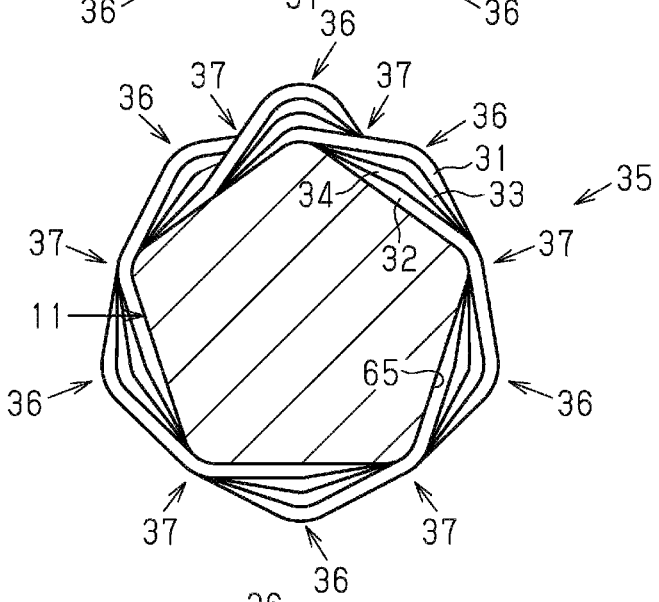

For example, as shown in FIG. 9B, the winding core portion 11 has a substantially pentagonal cross-sectional shape and has five peripheral surfaces 65. The twisted wire portion 35 configured with the respective wires 31 to 34 wound around the winding core portion 11 has five nodal portions 36 in one turn of the coil 30. As shown in FIG. 9B, in the twisted wire portion 35, one nodal portion 36 is disposed on each peripheral surface 65. Note that the number of nodal portions 36 of the twisted wire portion 35 can be arbitrarily changed. For example, a surface on which a plurality of nodal portions 36 are disposed and a surface on which the nodal portion 36 is not disposed may be formed on the respective peripheral surfaces 65.

Figure 9C:
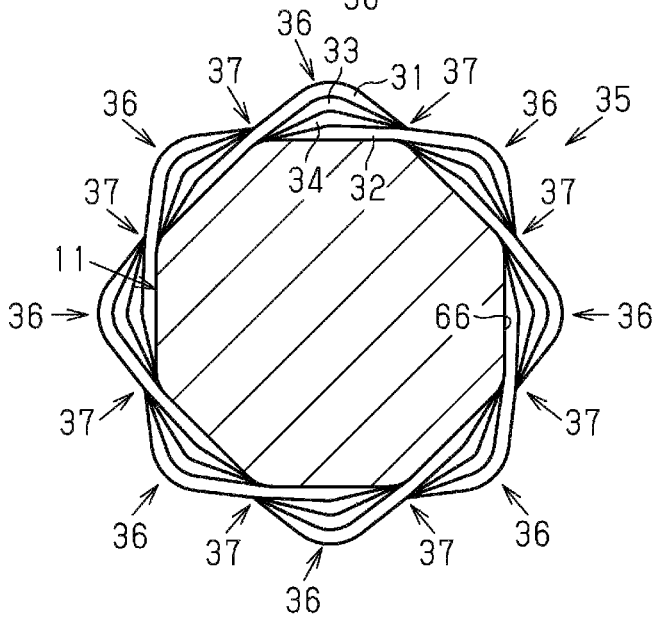

For example, as shown in FIG. 9C, the winding core portion 11 has a substantially octagonal cross-sectional shape and has eight peripheral surfaces 66. The twisted wire portion 35 configured with the respective wires 31 to 34 wound around the winding core portion 11 has eight nodal portions 36 in one turn of the coil 30. As shown in FIG. 9C, in the twisted wire portion 35, one nodal portion 36 is disposed on each peripheral surface 66. Note that the number of nodal portions 36 of the twisted wire portion 35 can be arbitrarily changed. For example, a surface on which a plurality of nodal portions 36 is disposed and a surface on which the nodal portion 36 is not disposed may be formed on the respective peripheral surfaces 66.

In the above embodiment and the above modification, connection relationships among the one end portion 31*a* to the one end portion 34*a* and the other end portion 31*b* to the other end portion 34*b* of the respective wires 31 to 34, and the respective terminal electrodes 21 to 28 are not limited to the connection relationships in the embodiment described above, and may be arbitrarily changed. In response to a change in connection relationship, the respective wiring patterns P1 to P6 of the circuit board PX are changed. That is, a wiring pattern for electrically connecting the other end portion 31*b* of the first wire 31 and the one end portion 33*a* of the third wire 33 has the first land portion, the second land portion, and the connection wiring portion. In addition, a wiring pattern for electrically connecting the other end portion 34*b* of the fourth wire 34 and the one end portion 32*a* of the second wire 32 has the first land portion, the second land portion, and the connection wiring portion.

In the above embodiment and the above modification, the electrical connection configuration between the other end portion 31*b* of the first wire 31 and the one end portion 33*a* of the third wire 33 is not limited to the first wiring pattern P1 of the circuit board PX, and can be arbitrarily changed. The terminal electrode to which the other end portion 31*b* of the first wire 31 is connected and the terminal electrode to which the one end portion 33*a* of the third wire 33 is connected may be connected to each other by a conductive material such as a metal plate or the like. In one example, the first terminal electrode 21 and the sixth terminal electrode 26 may be connected to each other by a conductive material.

In the above embodiment and the above modification, the electrical connection configuration between the other end portion 34*b* of the fourth wire 34 and the one end portion 32*a* of the second wire 32 is not limited to the second wiring pattern P2 of the circuit board PX, and can be arbitrarily changed. The terminal electrode to which the other end portion 34*b* of the fourth wire 34 is connected and the terminal electrode to which the one end portion 32*a* of the second wire 32 is connected may be connected to each other by a conductive material such as a metal plate or the like. In one example, the third terminal electrode 23 and the eighth terminal electrode 28 may be connected to each other by a conductive material.

In the above embodiment and the above modification, the length of the portion wound around the winding core portion 11 in the first wire 31, the length of the portion wound around the winding core portion 11 in the second wire 32, the length of the portion wound around the winding core portion 11 in the third wire 33, and the length of the portion wound around the winding core portion 11 in the fourth wire 34 may be configured to be mutually equal. In one example, the positional relationships among the first wire 31, the second wire 32, the third wire 33, and the fourth wire 34 in the twisted wire portion 35 are changed for each of the twisted wire portions 35. Thus, it is possible to form the positional relationships in which the third wire 33 and the fourth wire 34 are positioned at an outer side portion and the first wire 31 and the second wire 32 are positioned at an inner side portion in the antinodal portion 37 of the twisted wire portion 35. According to this configuration, since there is no variation in stray capacitance among the respective wires 31 to 34, the insertion loss of the coil component 1 in the entire frequency band can be further reduced.

Note that the length of the portion wound around the winding core portion 11 in the first wire 31, the length of the portion wound around the winding core portion 11 in the second wire 32, the length of the portion wound around the winding core portion 11 in the third wire 33, and the length of the portion wound around the winding core portion 11 in the fourth wire 34 are mutually equal, which means that an error within 3% of the length of the portion wound around the winding core portion 11 in the first wire 31, the length of the portion wound around the winding core portion 11 in the second wire 32, the length of the portion wound around the winding core portion 11 in the third wire 33, or the length of the portion wound around the winding core portion 11 in the fourth wire 34 is included.

Figure 10A:
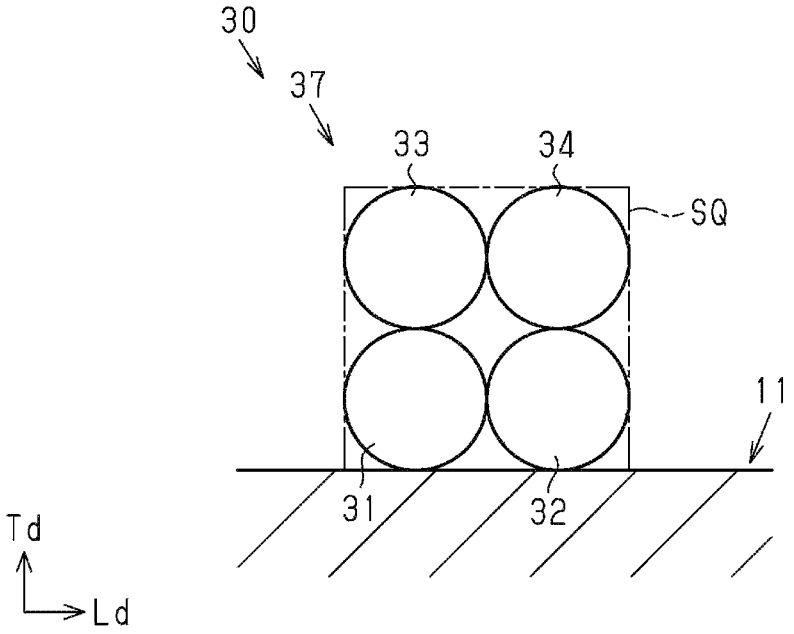
FIG. 10A is a schematic cross-sectional view showing a part of an antinodal portion of the coil in a coil component according to the modification.
Figure 10B:
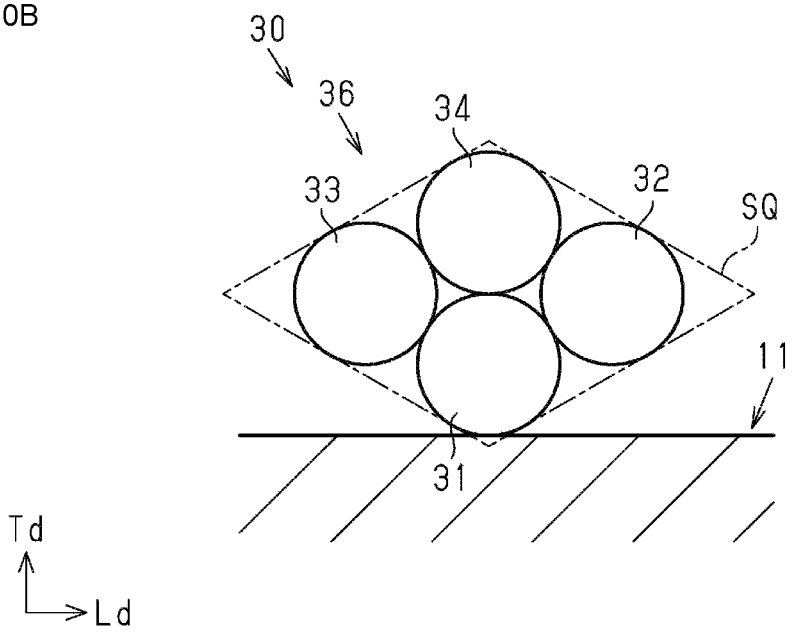
FIG. 10B is a schematic cross-sectional view showing a part of a nodal portion of the coil in the coil component according to the modification.

In the above embodiment and the modification, the winding portion 30*a* may be wound around the winding core portion 11 such that two wires of the wires 31 to 34 are directly wound on the peripheral surface of the winding core portion 11 and the other two wires are positioned on an outer periphery of the two wires wound on the peripheral surface of the winding core portion 11. FIG. 10A shows an example of the antinodal portion 37 of the winding portion 30*a* of the modification, and FIG. 10B shows an example of the nodal portion 36 of the winding portion 30*a* of the modification. In FIG. 10A, the winding portion 30*a* is configured such that the first wire 31 and the second wire 32 are in contact with the winding core portion 11, and the third wire 33 and the fourth wire 34 are stacked on an outer periphery of the first wire 31 and the second wire 32. In this case, when an outer periphery of the respective wires 31 to 34 is regarded as a substantially quadrangle SQ (dashed-dotted lines), the antinodal portion 37 is a portion where one side of the substantially quadrangle SQ is in contact with the winding core portion 11. In short, the antinodal portion 37 is a portion where at least two wires of the wires 31 to 34 are in contact with the peripheral surface of the winding core portion 11 and are aligned in a direction parallel to the peripheral surface of the winding core portion 11. In FIG. 10B, the winding portion 30*a* is configured such that the first wire 31 is in contact with the winding core portion 11, and the second to fourth wires 32 to 34 are separated from the winding core portion 11. In this case, the nodal portion 36 is a portion where one wire of the wires 31 to 34 is in contact with the peripheral surface of the winding core portion 11, and at least two wires are aligned in a direction perpendicular to the peripheral surface of the winding core portion 11.

In an electronic circuit including a coil component and a circuit board on which the coil component is mounted, the coil component 1 of the above embodiment and the above modification may be applied as the coil component. In the electronic circuit, the circuit board PX to which the coil component 1 is mounted may be applied as the circuit board.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a core including a winding core portion; and a first wire, a second wire, a third wire, and a fourth wire wound around the winding core portion, wherein a winding portion is formed by winding the first wire, the second wire, the third wire, and the fourth wire around the winding core portion, the winding portion includes a twisted wire portion in which the first wire, the second wire, the third wire, and the fourth wire are collectively twisted, the winding portion is formed of an antinodal portion in which the first, second, third and fourth wires are arranged adjacently to each other and in direct contact with the surface of the winding core portion when viewed from the vertical direction with respect to the peripheral surface of the winding core portion such that the first wire is adjacent to and in direct contact with the fourth wire while being wound around the winding core portion.

2. The coil component according to claim 1, wherein a twist number of the first wire, a twist number of the second wire, a twist number of the third wire, and a twist number of the fourth wire in the twisted wire portion are mutually equal.

3. The coil component according to claim 1, wherein in the twisted wire portion, the first wire, the second wire, the third wire, and the fourth wire are collectively twisted a plurality of times, and twisting directions of the twisted wire portion are the same direction.

4. The coil component according to claim 3, wherein positional relationships among the first wire, the second wire, the third wire and the fourth wire in the twisted wire portion are constant.

5. The coil component according to claim 1, wherein the winding portion is configured such that a length of a portion wound around the winding core portion in the first wire, a length of a portion wound around the winding core portion in the second wire, a length of a portion wound around the winding core portion in the third wire, and a length of a portion wound around the winding core portion in the fourth wire are mutually equal.

6. The coil component according to claim 1, wherein the coil component is a surface-mount type coil component.

7. The coil component according to claim 1, wherein the first wire, the second wire, the third wire, and the fourth wire form a coil having a lateral winding structure.

8. The coil component according to claim 1, wherein in the winding portion, the first wire, the second wire, the third wire, and the fourth wire are electrically insulated from one another.

9. The coil component according to claim 1, wherein each of the first wire, the second wire, the third wire, and the fourth wire has one end portion and an other end portion, in a state where the coil component is mounted on a circuit board on which a first wiring pattern and a second wiring pattern are formed, the other end portion of the first wire and the one end portion of the third wire are electrically connected to each other with the first wiring pattern interposed between the other end portion of the first wire and the one end portion of the third wire, and the one end portion of the second wire and the other end of the fourth wire are electrically connected to each other with the second wiring pattern interposed between the one end portion of the second wire and the other end portion of the fourth wire.

10. The coil component according to claim 2, wherein in the twisted wire portion, the first wire, the second wire, the third wire, and the fourth wire are collectively twisted a plurality of times, and twisting directions of the twisted wire portion are the same direction.

11. The coil component according to claim 2, wherein the winding portion is configured such that a length of a portion wound around the winding core portion in the first wire, a length of a portion wound around the winding core portion in the second wire, a length of a portion wound around the winding core portion in the third wire, and a length of a portion wound around the winding core portion in the fourth wire are mutually equal.

12. The coil component according to claim 3, wherein the winding portion is configured such that a length of a portion wound around the winding core portion in the first wire, a length of a portion wound around the winding core portion in the second wire, a length of a portion wound around the winding core portion in the third wire, and a length of a portion wound around the winding core portion in the fourth wire are mutually equal.

13. The coil component according to claim 4, wherein the winding portion is configured such that a length of a portion wound around the winding core portion in the first wire, a length of a portion wound around the winding core portion in the second wire, a length of a portion wound around the winding core portion in the third wire, and a length of a portion wound around the winding core portion in the fourth wire are mutually equal.

14. The coil component according to claim 2, wherein the coil component is a surface-mount type coil component.

15. The coil component according to claim 3, wherein the coil component is a surface-mount type coil component.

16. The coil component according to claim 2, wherein the first wire, the second wire, the third wire, and the fourth wire form a coil having a lateral winding structure.

17. The coil component according to claim 3, wherein the first wire, the second wire, the third wire, and the fourth wire form a coil having a lateral winding structure.

18. The coil component according to claim 2, wherein in the winding portion, the first wire, the second wire, the third wire, and the fourth wire are electrically insulated from one another.

19. The coil component according to claim 3, wherein in the winding portion, the first wire, the second wire, the third wire, and the fourth wire are electrically insulated from one another.

20. The coil component according to claim 2, wherein each of the first wire, the second wire, the third wire, and the fourth wire has one end portion and an other end portion, in a state where the coil component is mounted on a circuit board on which a first wiring pattern and a second wiring pattern are formed, the other end portion of the first wire and the one end portion of the third wire are electrically connected to each other with the first wiring pattern interposed between the other end portion of the first wire and the one end portion of the third wire, and the one end portion of the second wire and the other end of the fourth wire are electrically connected to each other with the second wiring pattern interposed between the one end portion of the second wire and the other end portion of the fourth wire.

21. The coil component according to claim 1, wherein the winding core portion has a cross-sectional shape having more than 4 sides when viewed along an axis of the core.

* * * * *